United States Patent [19]

Hassall

[11] 4,219,412

[45] Aug. 26, 1980

[54] SCREENING MACHINES

[75] Inventor: Anthony G. Hassall, Sandiway, England

[73] Assignee: N. Greening Limited, Great Britain

[21] Appl. No.: 833,314

[22] Filed: Sep. 14, 1977

[30] Foreign Application Priority Data

Apr. 7, 1977 [GB] United Kingdom ..... 14738/77

[51] Int. Cl.[2] ..... B07B 1/46

[52] U.S. Cl. ..... 209/399; 209/408

[58] Field of Search ..... 209/395, 412, 399, 393, 209/405, 408, 392; 52/475, 493, 482

[56] References Cited

U.S. PATENT DOCUMENTS

| | | | |
|---|---|---|---|
| 1,728,231 | 9/1929 | Denk | 52/482 X |
| 2,073,277 | 3/1937 | Mohl | 52/475 X |
| 2,202,850 | 6/1940 | Guignon | 52/497 |
| 2,249,106 | 7/1941 | Baumgartl | 52/475 X |
| 2,382,761 | 8/1945 | Wilks | 52/493 X |
| 2,740,525 | 4/1956 | Wehner | 209/399 |
| 2,777,579 | 1/1957 | Roubal | 209/412 |
| 2,822,584 | 2/1958 | Urbain | 52/497 X |
| 3,042,206 | 7/1962 | Olender | 209/395 |
| 3,081,875 | 3/1963 | Parks | 209/412 |
| 3,247,966 | 4/1966 | Marmon | 209/395 |
| 3,440,779 | 4/1969 | Melma | 52/475 |
| 3,667,182 | 6/1972 | Stemler | 52/497 |
| 3,980,555 | 9/1976 | Freissle | 209/399 X |
| 4,068,439 | 1/1978 | Andersen | 52/497 |

FOREIGN PATENT DOCUMENTS

| | | | |
|---|---|---|---|
| 1001166 | 8/1965 | United Kingdom | 209/399 |

*Primary Examiner*—Robert Halper

*Attorney, Agent, or Firm*—William A. Drucker

[57] ABSTRACT

Screening apparatus for aggregates or the like has a sieve screen comprising a plurality of sieve elements secured to a support frame of moulded synthetic plastics material, each element having a lug formed by an undercut peripheral depending skirt engaging a corresponding recessed sidewall of a groove in the frame. A support frame for such a sieve screen may be in the form of a lattice moulded from synthetic plastics material, preferably have cross members so spaced that each aperture of lattice will be obscured by a different one of the plurality of sieve elements. The frame may have a plurality of attachment bars projecting at intervals from the undersurface thereof and be supported in the apparatus by a plurality of spaced support bars, each bar having, at intervals along its length corresponding to the spacing of the attachment bars, apertures of a shape to receive said bars.

5 Claims, 5 Drawing Figures

SCREENING MACHINES

The invention relates to screening machines for aggregates and the like and particularly to sieve screens and screen support frames for such machines.

A modular sieve screen may be made up of synthetic plastics, e.g. polyurethane, sieve elements removably secured to a support frame by engaging upstanding lips of the frame with corresponding lugs of the element. For the upstanding lips to hold the element securely during operation of the machine they require to be relatively rigid and so are usually of metal. A disadvantage of such means of securing the elements is that the protruding upstanding lips constitute a hazard to maintenance workers who may have to clamber across the frame whilst the protrusions are exposed.

It is an object of the present invention to obviate or at least mitigate the above disadvantage.

Accordingly, one aspect of the present invention concerns a sieve screening machine comprising a plurality of sieve elements secured to a support frame of moulded synthetic plastics material each element having a lug formed by an undercut peripheral depending skirt engaging a corresponding recessed sidewall of a groove in the frame.

Another aspect of the invention concerns a support from for such a sieve screen and in the form of a lattice moulded from synthetic plastics material, preferably having cross members so spaced that each aperture of lattice will be obscured by a different one of a plurality of sieve elements which may be rectangular and are preferably square.

The recessed groove sidewall may be conveniently provided simultaneously for adjacent apertures by forming a slot inverted T section in each cross-member of the lattice.

A desired resistance to flexing of the groove sidewall may be provided by continuity of the groove sidewall around or across the aperture corners and/or by embedding substantially centrally of each aperture defining cross member a relatively short and rigid member of U-shape so that the limb portions of each member extend into but do not protrude from the sidewalls of the groove.

In preferred embodiments the support frame is attached to a supporting structure of the screening machine by means of a plurality of attachment bars projecting from the undersurface of and at intervals along the length of the support frame to extend across the width thereof, engaging with the support structure comprising a plurality of spaced support bars, each bar being provided at intervals along its length corresponding to the intervals of the attachment bars of the frame with apertures of a shape to receive the said attachment bars. Cambering of the support frame and hence the screen surface may be achieved by reason of the support bars having different heights across the width of the frame so that when the support frame is attached to the support bars it has the desired camber.

The attachment bars may have a cross-sectional shape such as to simpliy rest in the apertures in the apertures in the support bars of the support structure or such as to interfit in locking manner in such apertures.

An embodiment of the invention will now be described by way of example only and with reference to the accompanying drawings in which.

Figure 1:
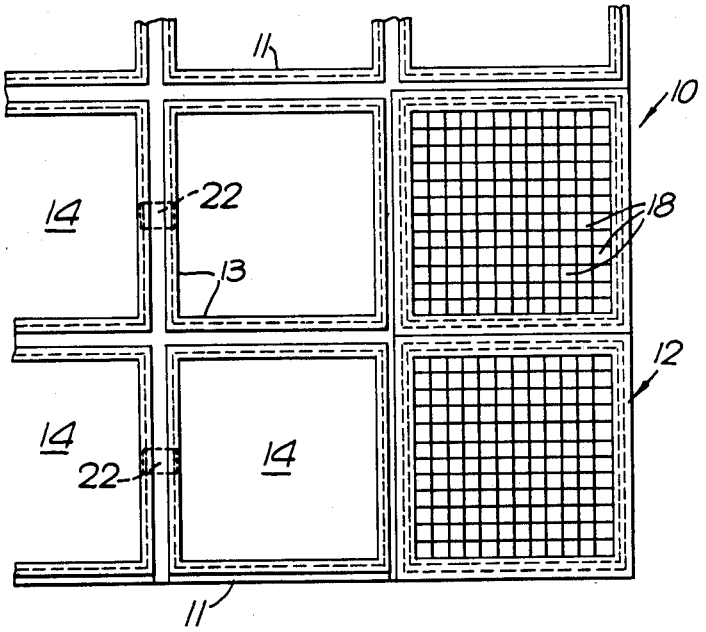
FIG. 1 is a plan view of a portion of a sieve screen and shows a support frame with some sieve elements secured thereto.

A modular sieve screen 10 comprises a support frame 11 to which are secured sieve elements 12.

The support frame is a moulded lattice of synthetic plastics material e.g. polyurethane. Each cross-member 13 of the lattice is spaced and adapted so that each aperture 14 in the lattice will accept and be obscured by a different one of a plurality of different sieve elements 12.

The upstream side of each cross-member 13 is formed with a groove 15. Each sidewall of the groove is recessed to form a lip 16 i.e. the groove is of inverted T section and intersection of the grooves in the cross-members defining a particular aperture produces a lip 16 completely surrounding that aperture.

Each sieve element 12 is a square moulding of synthetic plastics material e.g. polyurethane and has a plurality of central through holes 18 to act as the sieve. A peripheral depending skirt 19 of the element is undercut to form an inturned lug 20 extending around the entire periphery of the element. An inner face of the lug is provided at its lower part with an inclined surface 21.

When fitting an element to the support frame it is located over the aperture and forced downwards so that the lug 20 of the skirt portion of the element enters the groove of the support frame and engages beneath the lip 16 in the sidewall of the groove. Relative flexing of the skirt 19 and the groove sidewall and lip allow the element lug 20 to pass over the frame lip 16 and the flexing is assisted by the inclined surface 21 acting against the lip.

Slight undersizing of the element relative to the aperture may be desirable for a snug fit when the element is in position.

The width of each groove 15 is arranged to accommodate the two skirts of elements secured over adjacent apertures such that the edges of the elements are adjacent or abut to provide a substantially continuous upper surface for the sieve screen.

Various modifications of the embodiment are envisaged as follows.

Continuity of the groove sidewall and element skirt at least at the corners may provide a sufficiently rigid assembled screen and so the depending skirt of each sieve element need only be continuous around or across the corners of the element rather than around the entire periphery.

Increased resistance to flexing of the groove sidewalls may be required especially for larger elements e.g. 12 inches square, and may be provded by embedding substantially centrally of each aperture defining cross member a relatively short and rigid e.g. metal U-shaped reinforcement member.

Figure 2:
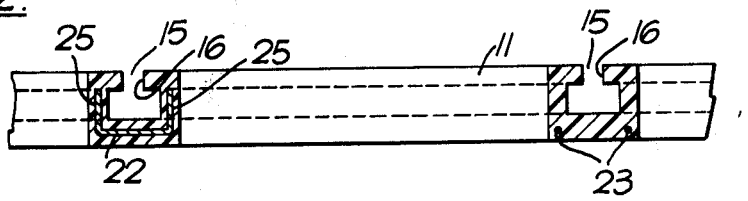
FIG. 2 is a sectional side view of a portion of the frame of FIG. 1.
Figure 3:
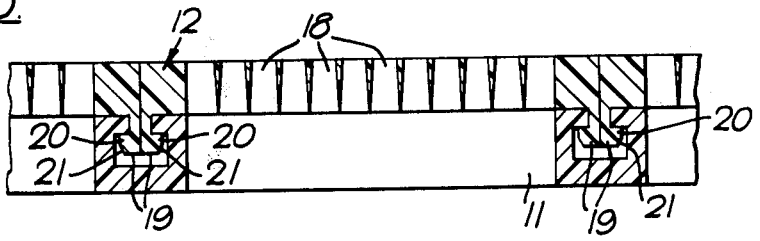
FIG. 3 is a sectional side view similar to FIG. 2 but with sieve elements secured to the frame.

FIGS. 1 and 2 show a U-shaped metal member 22 embedded mid-way along a cross-member 13 of the lattice such that limb portions 25 of the member extend into but do not protrude from the sidewall of the T shaped groove 15. Increased resistance to flexing of the lip 16 itself could be achieved by turning the ends of limbs 25 inwardly to extend into but not protrude from the lips.

An increase in the resistance to flexing of the frame as a whole may be provided by reinforcing rods or bars 23 moulded into the support frame during manufacture and may increase the resistance to flexing to such an extent that the support frame is self-supporting.

Where such reinforcing rods are provided they may be extended at the edges of the support frame and used to secure the support frame to the screening machine, possibly under tension.

Figure 4:
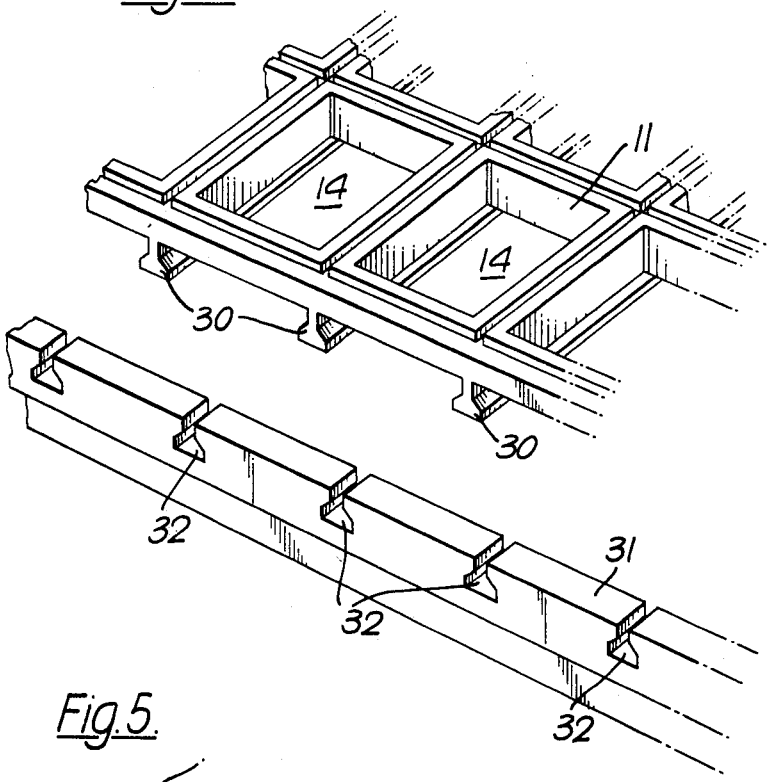
FIG. 4 is a perspective view of a part of a support frame and support bar prior to attachment of one to the other.

FIG. 4 illustrates the attachment of the support frame 11 to the machine. Formed integrally, for example during moulding, with the frame 11 to project from its undersurface are a plurality of attachment bars 30 of T-shape in section spaced apart along the length of the plate and extending across the full width of the plate. Each of a number of support bars 31, of which only one is shown in FIG. 4, has T-shaped slots 32 in its upper surface at intervals corresponding to the spacing of the bars 30 of the support frame 11. The slotted parts of these bars may be a capping of resilient non-metallic material secured to a more rigid base or the whole bar may be formed either of resilient or rigid material. Three or more bars such as 31 are spaced apart across the width of the deck of the machine, the bars having, or being mounted to have, different heights so that the slotted surfaces of all the bars define the desired camber to be formed by the screen when attached to the bars 31.

The support frame is located in position by threading the T-section bars 30 through the T-shaped slots in the successive supporting bars 31 across the width of the deck and clamping the edges of the support frame by any conventional clamping arrangement which may, if desired be arranged to tension the screen plate.

The bars 30 and corresponding slots in bars 31 need not be of T-shape in section but may be of L-shape or have the bar of the T of circular form, all of which sections would provide a locking effect. Where a positive locking effect is not needed, for example where the support frame is to be screwed to the support structure, the bars and slots may be of simple rectangular form.

The bars 30 may be formed, as previously mentioned, integrally with the frame by moulding the frame and bars simultaneously in the same material. They may also be formed integrally with frame 11 but in a material having a different degree of resilience so as to stiffen or otherwise modify the overall physical characteristics of the frame.

Figure 5:
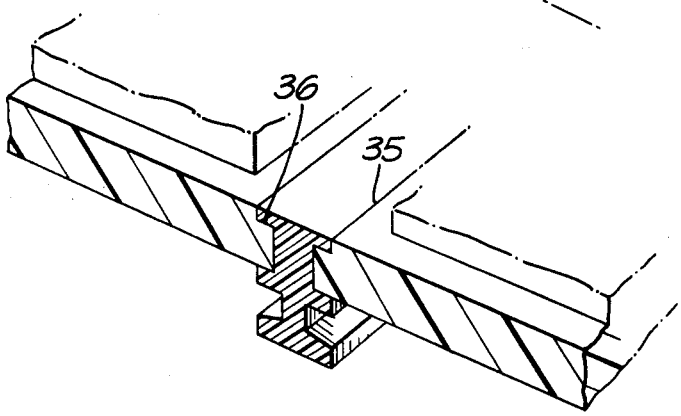
FIG. 5 is a sectional view of a part of the support frame showing an alternative way of providing attachment means on the support frame.

Instead of the bars 30 being formed integrally with the frame during the forming of such frame they may be added to a preformed frame having apertures of stepped form by moulding the bars into the stepped apertures as indicated in FIG. 5. In this alternative form of frame the frame is formed with the customary pattern of sieve element receiving apertures 14 together with a plurality of spaced apertures 35 lying in each of a plurality of spaced lines across the width of the screen, edges of apertures 35 being formed with a step 36. The preformed frame is then laid across a mould or a plurality of moulds shaped to provide the T-section of the attachment bars with the mould cavities in register with the lines of stepped form apertures in the frame. A suitable moulding liquid is then introduced to fill the mould cavities and the stepped apertures to form the T-section attachment to the frame.

This alternative way of providing the attachment bars is particularly useful when it is desired that the bars should have a different degree of resilient to that of the frame itself. It will be appreciated that under the same circumstances preformed bars could be incorporated as inserts in the moulding of the screen plate and that reinforcing rods could be incorporated into the frame or the attachment bars or both.

Either additionally or alternatively to the above arrangement the support frame may be attached to the machine by screwing or bolting the frame to an existing support framework, in which case screwholes may be provided in each cross-member.

Each screwhole may be provided through a plate embedded in the cross-member, in the bottom of groove 15 to distribute loading. Reinforcement rods 23 may again be provided even though the frame is attached to the machine in this alternative manner.

An advantage of embodiments of the invention is that they provide for secure engagement of the elements with the support frame without the need for upstanding metal protrusions which could constitute a hazard to operators or mainenance workers, and the absence of the necessity for protruding metal parts which often corrode in use leads to reduced maintenance.

A further advantage of embodiments of the invention is the ease of manufacturing the moulded support frame and also the moulded elements without the need for complicated metal inserts which require expensive manufacturing operations.

I claim:

1. A modular seive screen for a screening machine comprising a plurality of seive elements secured to a support frame in the form of a lattice moulded from synthetic plastic material, each said element having a lug formed by an undercut peripheral depending skirt engaging a corresponding recessed side wall of a groove in said frame, the cross members of the lattice being spaced so that each apperature of the lattice will be obscured by a different one of the plurality of seive elements, said support frame having a plurality of attachment bars projecting from the undersurface of and at intervals along the length of the support frame to extend across the width thereof, the support frame being supported by a support structure comprising a plurality of spaced support barseach bar being provided at intervals along its length corresponding to the intervals of the attachment bars of the frame with apperatures of a shape to receive said attachment bars.

2. Screening apparatus as claimed in claim 1, wherein the support bars having different heights across the width of the frame to produce a cambering of the frame when attached to the support bars.

3. Screening apparatus as claimed in claim 1, wherein the attachment bars have such a cross-sectional shape as to interfit in locking manner in the support bar apertures.

4. Screening apparaturs as claimed in claim 3, wherein the attachment bars are of T-section.

5. Screening apparatus as claimed in claim 4, including reinforcement wires or rods moulded into the attachment bars.

* * * * *